United States Patent [19]

Makins, Jr. et al.

[11] Patent Number: 4,716,961

[45] Date of Patent: Jan. 5, 1988

[54] ROTARY DRIVE APPARATUS FOR DOWNHOLD PUMP

[75] Inventors: James E. Makins, Jr.; James E. Thompson, both of Dallas County, Tex.

[73] Assignee: USX Engineers & Consultants, Inc., Pittsburgh, Pa.

[21] Appl. No.: 11,576

[22] Filed: Feb. 6, 1987

[51] Int. Cl.[4] ..... E21B 43/00

[52] U.S. Cl. ..... 166/68.5; 166/78; 417/424

[58] Field of Search ..... 166/68.5, 68, 78; 417/424 R, 424 A, 362, 365

[56] References Cited

U.S. PATENT DOCUMENTS

| | | | |
|---|---|---|---|
| 1,704,362 | 3/1929 | Johnson | 417/424 R |
| 1,709,478 | 4/1929 | Layne | 417/424 R |
| 2,107,481 | 2/1938 | Johnson | 417/424 R |
| 2,178,700 | 11/1939 | Penick et al. | 166/78 |
| 4,087,211 | 5/1978 | Pochyly | 417/424 R |
| 4,372,379 | 2/1983 | Kulhanek et al. | 166/68.5 |

*Primary Examiner*—James A. Leppink
*Assistant Examiner*—Hoang C. Dang
*Attorney, Agent, or Firm*—William F. Riesmeyer

[57] ABSTRACT

A rotary drive apparatus is provided for connection to a rotary drive string extending downwardly in a well to a rotary downhole pump. Separate axial load bearing and rotary drive spindles are provided and are separately connected to the rotary drive string by readily releasable connectors so as to permit axial adjustment of the rotary drive string while preventing loss of the string into the well in the event of release or slippage of one of the connectors. The design also permits repair or adjustment of the drive apparatus without removal of the rotary drive string from the well.

4 Claims, 2 Drawing Figures

ROTARY DRIVE APPARATUS FOR DOWNHOLD PUMP

BACKGROUND OF THE INVENTION

This invention relates to a rotary drive apparatus for a rotary downhole pump and particularly to an improvement in the connection between the rotary drive apparatus and a rotary drive string extending downwardly in a well to the pump.

Rotary pumps as distinguished from the reciprocating plunger type have been used in water wells for many years and more recently have proven beneficial for pumping wells bearing crude oil laden with sand. In relatively shallow water wells only limited axial adjustment of the rotary drive string is required with respect to the rotary drive apparatus. Therefore, a threaded rod and nut connection between the rotary drive apparatus and rotary drive string is suitable. Examples of this type of connection are shown in various catalogs of the Peerless Pump Division of the FMC Corporation. Also, conventional rotary couplings such as shown in U.S. Pat. No. 4,087,211, Pochyly, may be used, but have the same drawback with respect to axial adjustment as the threaded connection just mentioned. Significantly, greater axial adjustment as required for connection to deep oil well production strings is provided by the use of a slidable polish rod clamp as shown in U.S. Pat. No. 4,372,379, Kulhanek et al. However, accidential release or slippage of such a clamp type connection may result in loss of the rotary drive string down the well which can cause damage to the well and the down hole equipment located therein. Also, repair or adjustment of the rotary drive assembly or motor cannot be made without removal of the string or holding it in place with auxiliary equipment.

Therefore, it is a primary object of this invention to provide an improved rotary drive apparatus for rotary downhole pumps which permits significant axial adjustment of the rotary drive string and prevents accidental loss or slippage of the string in the well.

SUMMARY OF THE INVENTION

According to this invention a rotary drive apparatus is provided which has a housing, separate axial load bearing and drive spindles both rotatably mounted in the housing and first and second readily releasable connector means for connection of a rotary drive string to said axial load bearing and drive spindles, respectively. The first connector means prevents loss of the string in the well when the second connector means is released. The second connector means is a segmented clamp adapted to be freely slidable in the axial direction of the drive spindle so that substantially all of the weight of the rotary drive string is borne by the axial load bearing spindle. The second connector means may be released from the drive spindle so as to permit repair or adjustment of the drive apparatus without removing the string from the well. Preferrably, the axial load bearing spindle is located above the drive spindle. In this case, stop means may be located in fixed position, for example on a frame supporting the rotary drive apparatus, said stop means being below the second connector and beneath the housing to catch the second connector and prevent loss of the string down the well in the event that first connector slips or is accidentally released.

DESCRIPTION OF THE PREFERRED EMBODIMENT

Figure 1:
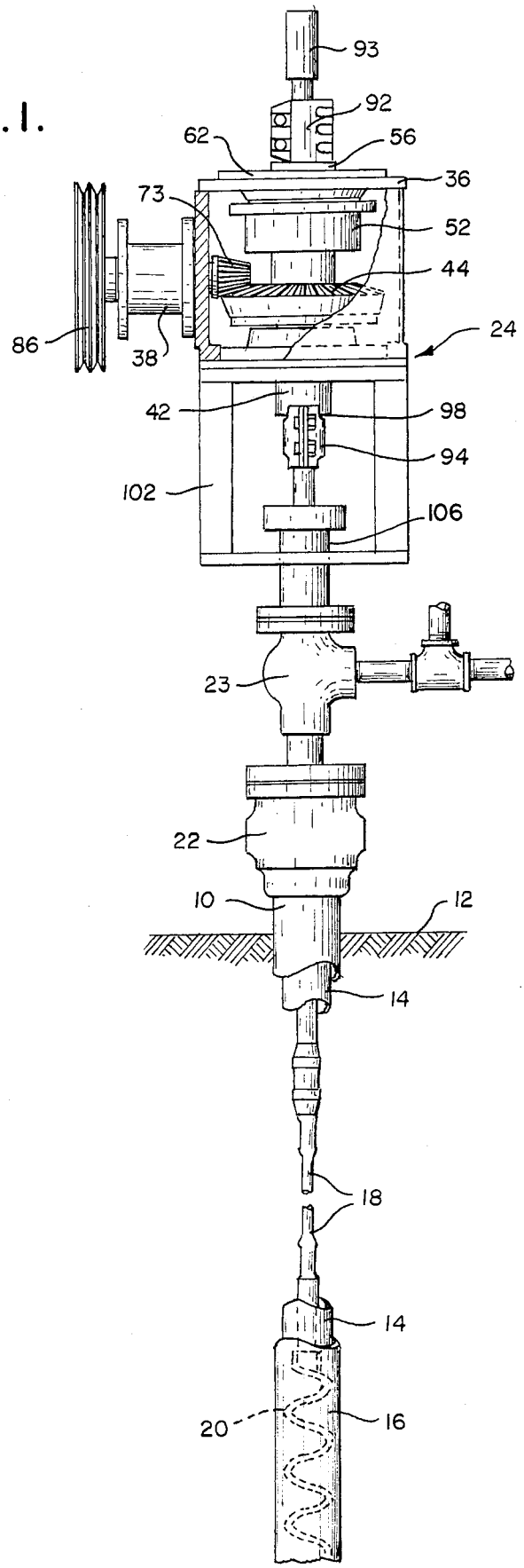
FIG. 1 is a schematic side elevational view of the rotary drive apparatus of this invention together with a well head and a rotary drive string extending downwardly in a well to a downhole rotary pump.

Referring to FIG. 1 a well casing 10 extends downwardly from the earth's surface 12. A production tubing string 14 is contained within the well casing and has a downhole rotary pump 16 at the lower end thereof. A rotary drive string 18 connected to the pump rotor 20 extends upwardly through a well head 22 to the rotary drive apparatus 24.

Figure 2:
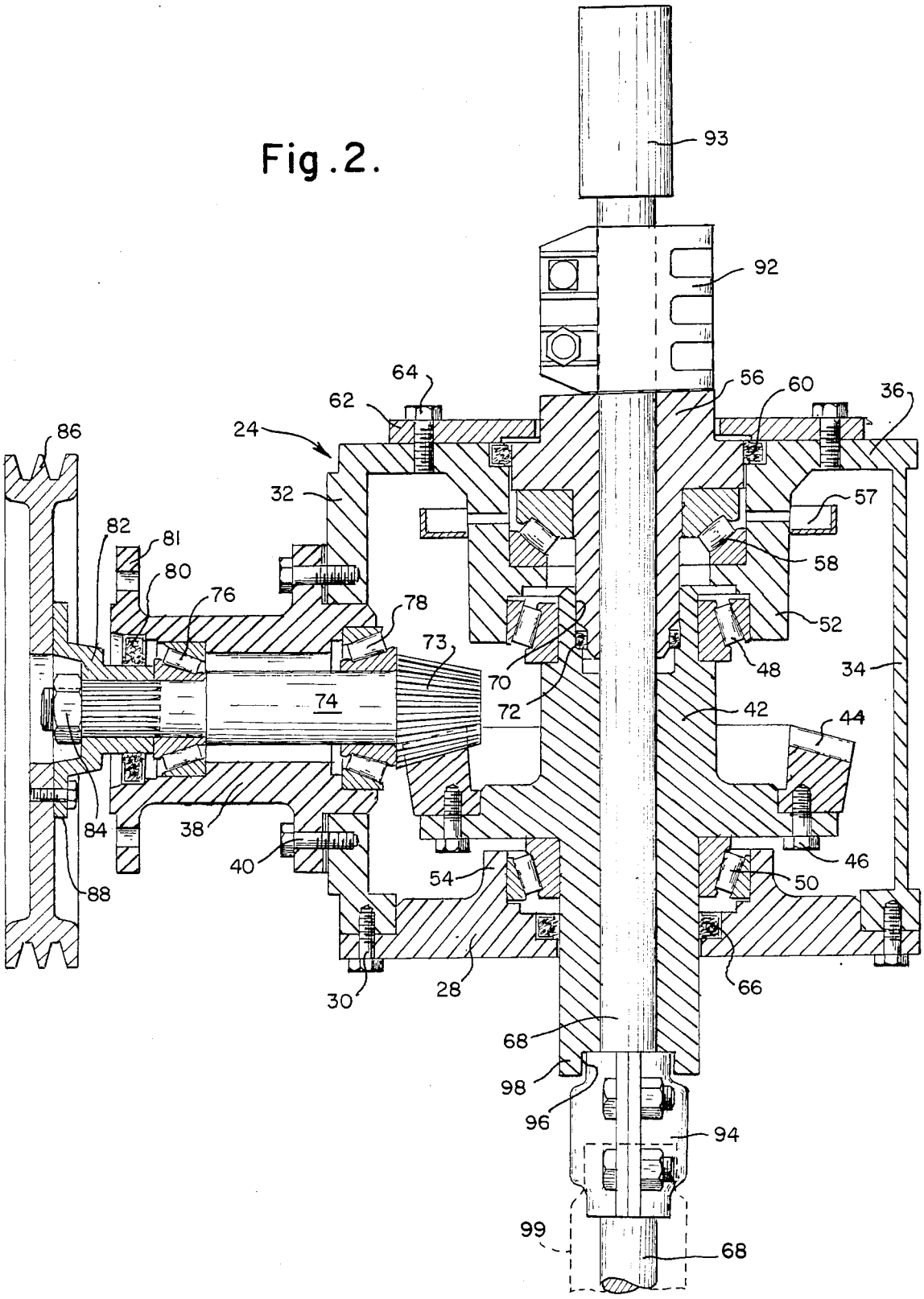
FIG. 2 is an enlarged vertical half section taken in the plane of FIG. 1 of the rotary apparatus shown in FIG. 1.

According to this invention, rotary drive apparatus 24 includes a housing comprising bottom plate 28 which is secured by a plurality of bolts 30 to four sideplates, two of which are illustrated at 32 and 34 in FIG. 2. Top plate 36 is integral with the sideplates. A tubular pinion shaft housing 38 is secured by a plurality of bolts 40 to sideplate 32. A drive spindle 42 is mounted in the housing and has beveled ring gear 44 secured thereto by a plurality of bolts 46. Tangential load carrying radial bearings 48 and 50 rotatably support the drive spindle in flanges 52 and 54 of the top and bottom plates, respectively. Axial load bearing spindle 56 is mounted above drive spindle 42 in the housing and is rotatably supported by load carrying thrust bearing ring 58 mounted within flange 52 of the top plate 36. Seal 60 is provided between top plate 36 and axial load bearing spindle 56 at the top of the housing. Cover plate 62 is secured to top plate 36 by a plurality of bolts 64. Coverplate 62 serves as a retainer for seal 60. Seal 66 is provided at the joint between bottom plate 28 and drive spindle 42. Drive spindle 42 and axial load bearing spindle 56 each have an oversize passage so that polish rod 68, which forms part of rotary drive string 18, is freely slidable in said passage. Drive spindle 42 has a counterbore 70 for receipt of a lower end of axial load bearing spindle 56 therein. Seal 72 is provided between the adjoining surfaces of counterbore 70 and axial load bearing spindle 56. Pinion shaft 74 is rotatably mounted in bearing rings 76 and 78 within pinion shaft housing 38. Seal 80 is provided between pinion flange coupling 82 and pinion shaft housing 38. The pinion shaft housing has an outer flange 81 with holes for bolts which may be used to attach a belt guard to the pinion shaft housing. Pinion flange coupling 82 mateably engages a splined portion of pinion shaft 74 and is secured on the shaft by nut 84. Belt pulley 86 is bolted to flange 88 of the pinion shaft housing. A belt (not shown) mounted on pulley 86 connects a motor drive to pinion shaft 74. A polish rod clamp 92 serving as a first connector rests on the upper surface of axial load bearing spindle 56 and grips polish rod 68. Similarly, polish rod clamp 94 serving as a second connector grips a lower portion of polish rod 68 and lockingly engages slot 96 in drive dog 98 at the lower end of spindle 42. Various other types of connectors may be used as long as they are axially adjustable with respect to the polish rod. Preferably segmented clamp type connectors are used. It is essential that the second connector be freely slidable with respect to drive spindle 42, for example from a position lockingly engaging slot 96 (FIG. 2) to a lowered position (shown by dotted lines 99 in FIG. 2) out of engagement with slot 96, so that substantially all of the weight of the rotary drive string is borne by the axial load bearing spindle. The first connector at the upper location may threadedly engage or be welded to the axial load bearing spindle if desired. An advantage of providing the first connector at the upper location above the housing is that a stop means can be provided below the second connector to "catch" the string in the event of accidental release or slippage of the first connector. Stuffing box 106 mounted in frame 102 serves as such a stop means. In the event of release polish rod clamp 92, the string can only descend until the stuffing box is abutted by polish rod clamp 94, preventing loss of the string down the well.

I claim:

1. A rotary drive apparatus adapted for connection to a rotary drive string extending downwardly in a well to a rotary downhole pump, said rotary drive apparatus comprising:

a housing having top and bottom surfaces with mateably aligned openings therein;

a drive spindle in said housing having an oversize passage for receiving the rotary drive string axially and in a freely slidable manner therein; said drive spindle having a slot at the lower end thereof;

an axial load bearing spindle rotatably mounted in said housing above and separately from the drive spindle, said axial load bearing spindle also having an oversize passage for receiving said rotary drive string axially therein;

bearing means for rotatably mounting the axial load bearing and drive spindles in said housing;

first and second clamp type connector means for connection of said rotary drive string to said axial load bearing spindle and said drive spindle, respectively;

said second connector means being a segmented clamp for lockingly engaging said slot in the lower end of the drive spindle, said segmented clamp when released being freely slidable axially on said drive spindle so that substantially all of the weight of the rotary drive string is borne by the axial load bearing spindle;

a frame for support of said rotary drive apparatus and a stop means mounted in said frame and located beneath the second connector means, said stop means being adapted to prevent loss of the rotary drive string down the well upon release or slippage of said first connector means and to provide support for the rotary drive string upon release of said first connector so that the axial load bearing spindle may be repaired or replaced without removal of the rotary drive string from said rotary drive apparatus.

2. The rotary drive apparatus of claim 1 wherein said drive spindle has a counterbore for receiving an end of the load bearing spindle slidably therein.

3. The rotary drive apparatus of claim 1 wherein said first connector means also comprises a segmented clamp for releasably gripping the rotary drive string.

4. The rotary drive apparatus of claim 2 further comprising sealing means located between an outer surface of said axial load bearing spindle and an inner surface of the countersunk bore in said drive spindle.

* * * * *